US011287176B2

(12) United States Patent
Vijayan et al.

(10) Patent No.: US 11,287,176 B2
(45) Date of Patent: Mar. 29, 2022

(54) COOLING SYSTEM FOR REFRIGERATOR APPLIANCE WITH FLEXIBLE CHAMBER IN DOOR

(71) Applicant: Haier US Appliance Solutions, Inc., Wilmington, DE (US)

(72) Inventors: Vineeth Vijayan, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 167 days.

(21) Appl. No.: 16/595,642

(22) Filed: Oct. 8, 2019

(65) Prior Publication Data

US 2021/0102745 A1 Apr. 8, 2021

(51) Int. Cl.
*F25D 23/04* (2006.01)
*F25D 23/10* (2006.01)

(52) U.S. Cl.
CPC ..... *F25D 23/04* (2013.01); *F25D 23/10* (2013.01)

(58) Field of Classification Search
CPC ..... F25D 23/025; F25D 2317/062; F25B 5/00
See application file for complete search history.

(56) References Cited

U.S. PATENT DOCUMENTS

| | | | | |
|---|---|---|---|---|
| 6,125,870 | A | 10/2000 | Furmanek | |
| 10,663,207 | B2 * | 5/2020 | Jeong | F25D 17/065 |
| 2017/0122648 | A1 * | 5/2017 | Park | F25D 11/02 |
| 2019/0226733 | A1 * | 7/2019 | Matsuzaki | F25B 41/37 |

FOREIGN PATENT DOCUMENTS

| | | | |
|---|---|---|---|
| CN | 109056270 | A | 12/2018 |
| KR | 200150324 | Y1 | 7/1999 |

* cited by examiner

*Primary Examiner* — Ana M Vazquez
(74) *Attorney, Agent, or Firm* — Dority & Manning, P.A.

(57) ABSTRACT

A refrigerator appliance includes a fresh food chamber, a freezer chamber, and a flexible chamber defined in a door of the refrigerator appliance. The refrigerator appliance also includes a cooling system configured to provide cooled air to the fresh food chamber, the freezer chamber, and the flexible chamber. The sealed cooling system includes a fresh food fan configured to urge air from at least a first part of the cooling system to the fresh food chamber, a door-in-door fan configured to urge air from at least a second part of the cooling system to the flexible chamber, and a freezer fan configured to urge air from a third part of the cooling system to the freezer chamber.

6 Claims, 10 Drawing Sheets

COOLING SYSTEM FOR REFRIGERATOR APPLIANCE WITH FLEXIBLE CHAMBER IN DOOR

FIELD OF THE INVENTION

The present disclosure relates generally to refrigerator appliances.

BACKGROUND OF THE INVENTION

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In certain refrigerator appliances, commonly referred to as side-by-side style refrigerator appliances, the fresh food chamber is positioned next to the freezer chamber within the cabinet. Such a configuration can permit easy access to food items stored on doors of the refrigerator appliances. However, the cabinet can be deep and narrow such that accessing food items at a back of the fresh food chamber and/or freezer chamber is difficult. Also, side-by-side refrigerators typically provide a fresh food chamber which is significantly larger, e.g., about fifty percent larger or more, than the freezer chamber. For example, the fresh food chamber may occupy about sixty percent or more of the cabinet width and the freezer chamber may occupy only forty percent or less. Such configurations can be difficult to accommodate larger frozen items.

In other refrigerator appliances, commonly referred to as bottom mount refrigerator appliances, the freezer chamber is positioned below the fresh food chamber in the cabinet. Such a configuration can provide a relatively wide fresh food chamber and/or freezer chamber, e.g., as compared to the side-by-side configuration. However, the depth of the fresh food chamber and the freezer chamber can make accessing food items at a back of the refrigerator appliance difficult.

Accordingly, a refrigerator appliance with features for assisting with accessing food items stored therein would be useful.

BRIEF DESCRIPTION OF THE INVENTION

Aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction and a transverse direction. The vertical, lateral and transverse directions are mutually perpendicular. The refrigerator appliance includes a cabinet that extends from a top to a bottom along the vertical direction. The cabinet also extends from a left side to a right side along the lateral direction. The cabinet defines a fresh food chamber and a freezer chamber. The fresh food chamber extends along the vertical direction between the top and the bottom of the cabinet, along the lateral direction between the left and right sides of the cabinet, and along the transverse direction between a front portion and a back portion. The front portion of the fresh food chamber defines an opening for receipt of food items. A door is rotatably mounted to the cabinet at the front portion of the fresh food chamber such that the door rotates between a closed position where the door sealingly encloses at least a portion of the fresh food chamber and an open position to permit access to the fresh food chamber. The door includes an outer casing having a thermally insulated wall. A flexible chamber is defined within the door by the outer casing. A front panel is rotatably mounted to the outer casing of the door such that the front panel of the door permits access to the flexible chamber. The refrigerator appliance also includes a sealed cooling system configured to provide cooled air to the fresh food chamber, the freezer chamber, and the flexible chamber. The sealed cooling system includes a single loop with a working fluid sealed within the single loop, a compressor, and a condenser downstream of the compressor with respect to the flow direction of the working fluid. The sealed cooling system also includes a plurality of evaporators downstream of the condenser with respect to the flow direction of the working fluid. A fresh food fan is configured to urge air from a first part of the cooling system to the fresh food chamber. A door-in-door fan is configured to urge air from at least one of the first part of the cooling system or a second part of the cooling system to the flexible chamber. A freezer fan is configured to urge air from a third part of the cooling system to the freezer chamber.

In another exemplary embodiment, sealed cooling system for a refrigerator appliance is provided. The refrigerator appliance includes a freezer chamber, a fresh food chamber, and a flexible chamber defined in a door of the refrigerator appliance. The sealed cooling system includes a single loop with a working fluid sealed within the single loop, a compressor, and a condenser downstream of the compressor with respect to the flow direction of the working fluid. The sealed cooling system also includes a plurality of evaporators downstream of the condenser with respect to the flow direction of the working fluid. A fresh food fan is configured to urge air from a first part of the cooling system to the fresh food chamber. A door-in-door fan is configured to urge air from at least one of the first part of the cooling system or a second part of the cooling system to the flexible chamber. A freezer fan is configured to urge air from a third part of the cooling system to the freezer chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
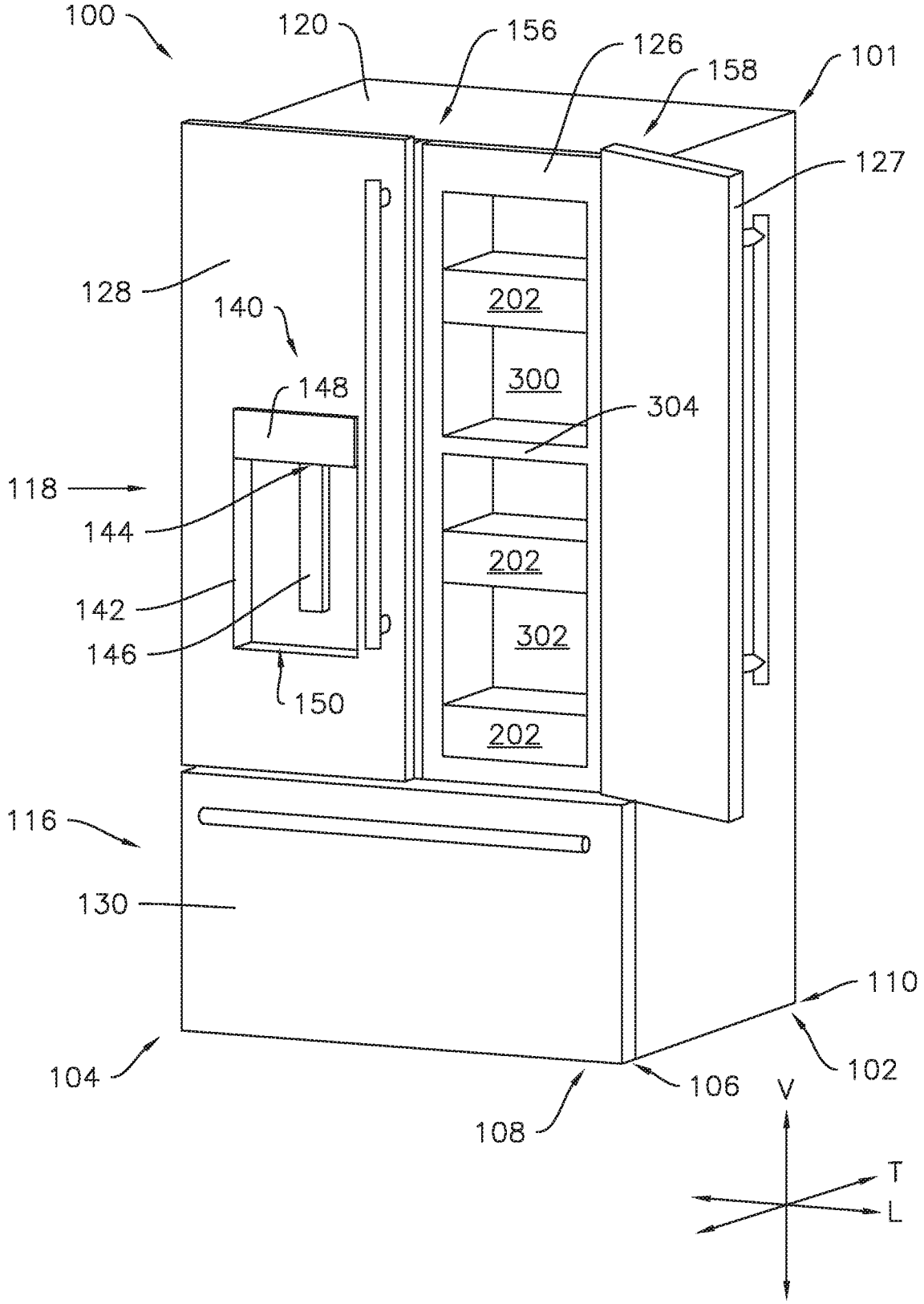
FIG. 1 provides a perspective view of an exemplary refrigerator appliance according to one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
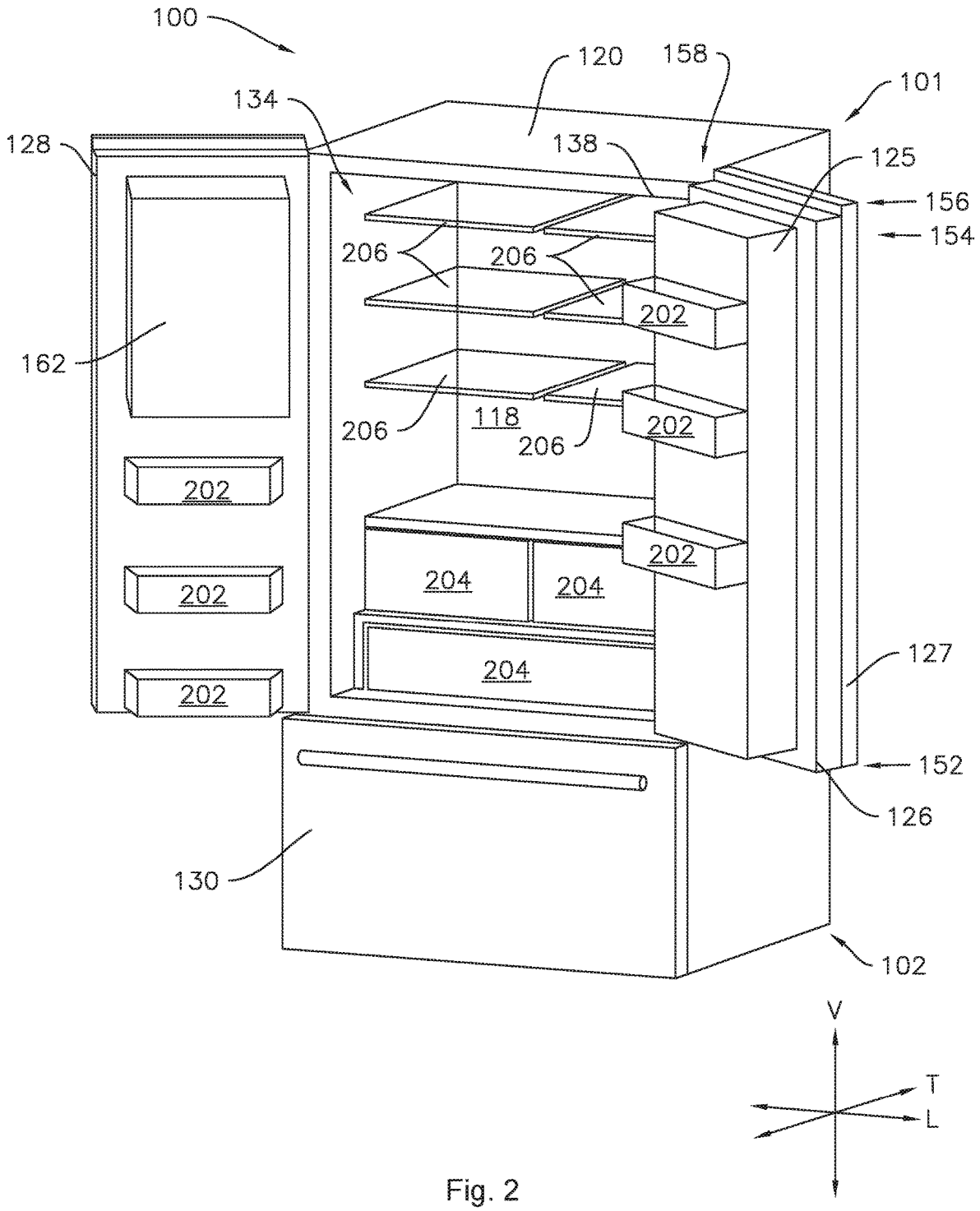
FIG. 2 provides a view of the refrigerator appliance of FIG. 1 with a left door and a right door both in an open position.

FIGS. 1 and 2 provide perspective views of an exemplary refrigerator appliance 100 according to one or more embodiments of the present subject matter with doors 126, 128 (described in more detail below) in various positions. Refrigerator appliance 100 defines a vertical direction V, a lateral direction L, and a transverse direction T, each mutually perpendicular to one another. As may be seen in FIGS. 1 and 2, refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines a chilled chamber 118 (FIG. 2) for receipt of food items for storage. As used herein, the chamber may be "chilled" in that the chamber is operable at temperatures below room temperature, e.g., less than about seventy-five degrees Fahrenheit (75° F.).

Figure 3:
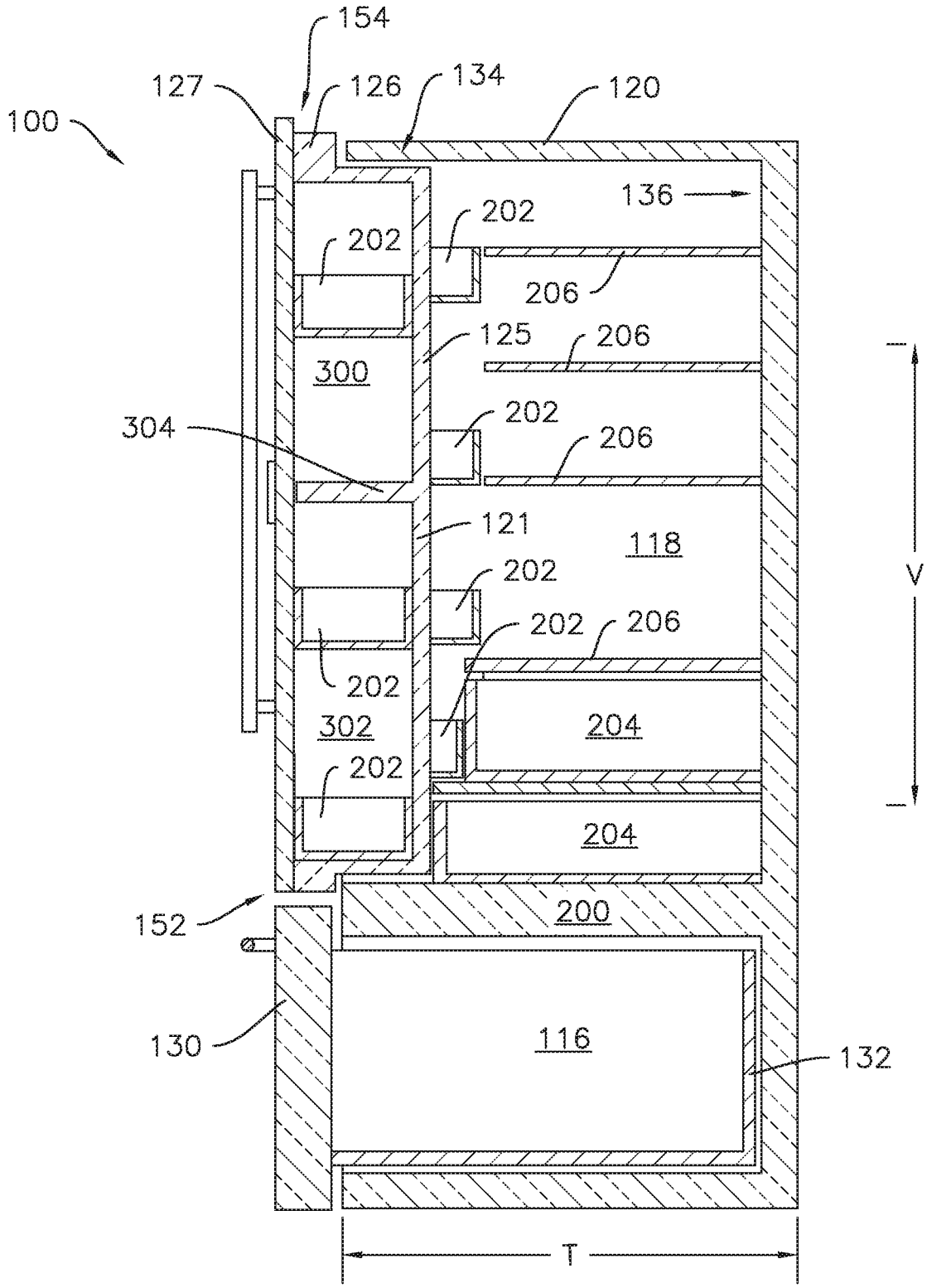
FIG. 3 provides a right side section view of the refrigerator appliance of FIG. 1.

As may be seen in FIG. 2, the chilled chamber 118 extends along the vertical direction V between the top 101 and the bottom 102 of the cabinet 120 and along the lateral direction L between the left side 104 and the right side 106 of the cabinet 120. The chilled chamber 118 also extends along the transverse direction T between a front portion 134 and a back portion 136 (FIG. 3). The front portion 134 of the chilled chamber 118 defines an opening 138 for receipt of food items.

In some embodiments, the chilled chamber 118 may be a single continuous chamber, e.g., a fresh food storage chamber 118 as shown in FIGS. 1 through 3. In such embodiments, a separate freezer chamber 116 may be provided. For example, the refrigerator appliance 100 may include the freezer chamber 116 below the fresh food storage chamber 118, as illustrated for example in FIGS. 1 through 3. In other embodiments, a single chilled chamber may occupy all or approximately all of the interior volume of the cabinet 120. In such embodiments, the single chilled chamber may be divided into two or more portions operable at different temperatures. For example, the single chilled chamber may be divided into a fresh food portion and a freezer portion.

As shown for example in FIG. 2, various storage components may be mounted within the fresh food chamber 118, and within one or more in-door storage chambers, such as a first flexible chamber 300 and a second flexible chamber 302, to facilitate storage of food items therein as will be understood by those skilled in the art. In particular, the storage components may include various combinations of bins 202, drawers 204, and shelves 206 mounted within the fresh food chamber 118 and/or one or both flexible chambers 300 and 302. Bins 202, drawers 204, and shelves 206 are configured for receipt of food items (e.g., beverages and/or solid food items) and may assist with organizing such food items.

Refrigerator doors 126 and 128 are rotatably mounted, e.g., hinged, to an edge of housing 120 for selectively accessing the fresh food chamber 118 within the housing 120. Refrigerator doors 126 and 128 may be mounted to the housing 120 at or near a front portion 134 of the fresh food chamber 118 such that the doors 126 and 128 rotate between a closed position (FIG. 1) and an open position (FIG. 2). In the closed position, the doors 126 and 128 cooperatively sealingly enclose the fresh food chamber 118. Additionally, one or more gaskets and other sealing devices, which are not shown but will be understood by one of ordinary skill in the art, may be provided to promote sealing between the doors 126 and 128 and the cabinet 120. In the open position the doors 126 and 128 permit access to the fresh food chamber 118. In embodiments where a separate freezer chamber 116 is provided, the freezer chamber 116 may be spaced apart from the fresh food chamber 118 along the vertical direction V. For example, the freezer chamber 116 may be positioned below the fresh food chamber 118, as illustrated, or may be positioned above the fresh food chamber 118, e.g., in a top mount configuration. A freezer door 130 may be arranged adjacent to, e.g., below, refrigerator doors 126 and 128 for selectively accessing freezer chamber 116. Freezer door 130 may be coupled to a freezer drawer 132 (FIG. 3) slidably mounted within freezer chamber 116. The doors 126 and 128 may be generally mirrored, e.g., the overall shape and size of each door 126 or 128 may be the same as the other door 126 or 128, with possible internal variations such as the dispenser recess 150 described below. Moreover, although not specifically shown, the doors 126 and 128 are independently rotatable such that, e.g. the right door 126 may be in the open position while the left door 128 is in the closed position, or vice versa.

As may be seen in FIG. 1, refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 126 and 128, such as left door 128 as in the illustrated exemplary embodiment. Dispenser 142 includes a discharging outlet 144 for accessing ice and liquid water. For example, ice may be stored in an ice box 162 (FIG. 2) in one of the doors 126 or 128. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned on an exterior side of one of the refrigerator doors 126 and 128, e.g., left door 128 as in the illustrated example embodiment, at a predetermined elevation convenient for a user to access ice or water and enabling the user to access ice without the need to bend-over and without the need to open doors 126 and 128. In the exemplary embodiment, dispenser recess 150 is positioned at a level that approximates the chest level of a user.

Refrigerator doors 126, 128 are shown in the closed position in FIG. 1. One of the refrigerator doors, e.g., right door 126 as in the illustrated example, may include an outer casing 121 (FIG. 3) comprising a thermally insulated wall 125 (FIG. 3) which defines one or more flexible storage chambers within the door, e.g., right door 126. In some embodiments, an optional thermally insulated mullion 304, as illustrated, e.g., in FIG. 1, may be included and may be positioned within the outer casing 121. The outer casing 121 defines at least one storage chamber, e.g., in embodiments where the mullion 304 is provided, a first flexible chamber 300 and a second flexible chamber 302 which are defined by the outer casing 121 and the mullion 304. In other embodiments without the mullion 304, a single chamber may be defined within the door. Thus, it should be understood that the description herein of multiple chambers within the door separated and defined by the mullion 304 is by way of example only and the present disclosure, in particular the cooling system which will be described in more detail with respect to FIGS. 4-10, is not limited to two in-door chambers and is equally applicable to only one chamber within the door, or more than two chambers.

The door, e.g., right door 126, may also include a front panel 127 rotatably mounted to the outer casing 121 to selectively sealingly enclose or permit access to the first and second flexible chambers 300 and 302. For example, the front panel 127 may permit access to the flexible chambers 300 and 302 when the door 126 is in the closed position, as shown for example in FIG. 1. As will be described in more detail below, the flexible chambers 300 and 302 may be selectively operable at a variety of temperatures.

In various embodiments, fresh food storage chamber 118 may be operable within a temperature range above the freezing point of water and below room temperature, such as between approximately thirty-three degrees Fahrenheit (33° F.) and approximately sixty degrees Fahrenheit (60° F.). Also by way of example, the freezer chamber 116 may be operable within a temperature range including temperatures below the freezing point of water, e.g., less than thirty-two degrees Fahrenheit (32° F.), such as between approximately thirty degrees Fahrenheit (30° F.) and approximately zero degrees Fahrenheit (0° F.). For example, a temperature of the fresh food storage chamber 118 may be about forty degrees Fahrenheit (40° F.) or about forty-five degrees Fahrenheit (45° F.) and a temperature of the freezer chamber 116 may be about fifteen degrees Fahrenheit (15° F.) or about twenty-five degrees Fahrenheit (25° F.). In various embodiments, a thermally insulated partition 200 may be provided within the cabinet 120, e.g., between the fresh food chamber 118 and the freezer chamber 116 (FIG. 3). The partition 200 may separate the distinct chambers or portions. The partition 200 may be a horizontal partition, e.g., partition 200 may extend along a plane perpendicular to the vertical direction V, e.g., a plane defined by the lateral direction L and the transverse direction T. The thermally insulated partition 200 may permit or enhance operation of the fresh food chamber 118 and the freezer chamber 116 at distinct temperatures.

The flexible chambers 300 and 302 may be selectively operable as either fresh food storage chambers or freezer chambers, e.g., within one of a first temperature range and a second temperature range. For example, the first and second flexible chambers 300 and 302 may be operable as fresh food storage chambers wherein the chambers 300 and 302 each provide an internal temperature within one or more of the fresh food storage temperature ranges described above, e.g., above the freezing point of water and below room temperature, such as between approximately thirty-three degrees Fahrenheit (33° F.) and approximately sixty degrees Fahrenheit (60° F.). The flexible chambers 300 and 302 may also be selectively operable to provide internal temperatures below the freezing point of water, e.g., between approximately thirty degrees Fahrenheit (30° F.) and approximately zero degrees Fahrenheit (0° F.), as described above.

The flexible chambers 300 and 302 may be operable at distinct temperatures. For example, when both flexible chambers 300 and 302 are operating as fresh food storage chambers, the first flexible chamber 300 may be operable at a relatively warm temperature, such as about fifty degrees Fahrenheit (50° F.), e.g., for chilling wine, and the second flexible chamber may be operable at a relatively cool temperature, such as about thirty-seven degrees Fahrenheit (37° F.), e.g., for storing produce. As another example, when both flexible chambers 300 and 302 are operating as freezer chambers, the first flexible chamber 300 may provide a soft freeze, e.g., may be operable at a temperature such as about twenty-five degrees Fahrenheit (25° F.), and the second flexible chamber may provide a deep freeze, e.g., may be operable at a temperature such as about fifteen degrees Fahrenheit (15° F.) or less, such as about ten degrees Fahrenheit (10° F.) or less, such as about zero degrees Fahrenheit (0° F.) or less. In such examples, the deep freeze chamber may also provide a quick freeze, e.g., for rapidly freezing fresh-picked produce or fresh meat, etc. In yet another example, one of the flexible chambers 300 and 302 may be operated as a fresh food storage chamber, e.g., within a temperature range above the freezing point of water and below room temperature, as described above, while the other of the flexible chambers 300 and 302 is operated as a freezer chamber, e.g., within a temperature range including temperatures below the freezing point of water, as described above.

One of ordinary skill in the art will recognize that the various chambers or portions may be chilled by a sealed refrigeration system, such that, e.g., the first flexible chamber 300 and the second flexible chamber 302 may be operable at or about the temperatures described above by providing chilled air from the sealed system. For example, the flexible chamber or chambers may be selectively operable at fresh food temperatures or freezer temperatures. Exemplary embodiments of the sealed system are described in further detail below.

As best seen in FIGS. 1 and 3, the flexible chambers 300 and 302 may be generally coextensive with the door 126. For example, as seen in FIG. 3, the flexible chambers 300, 302 and the door 126 may be generally coextensive along the vertical direction V, e.g., the flexible chambers 300 and 302 may collectively define a vertical height (or in embodiments without the mullion 304, the single flexible chamber by itself may define the height) which may be about the same (excepting the thickness of the thermally insulated wall 125) as a vertical height of the door 126. The flexible chambers 300, 302 and the door 126 may also be generally coextensive along a direction perpendicular to the vertical direction V, e.g., at least one of the lateral direction L and the transverse direction T, e.g., depending on the orientation of the door 126, e.g. whether the door 126 is in the closed position or the open position. For example, the door 126 may extend between a left side 156 and a right side 158, e.g., along the lateral direction L when the door 126 is in the closed position, as illustrated in FIG. 1. In such embodiments, the first flexible chamber 300 and the second flexible chamber 302 may each extend from the left side 156 of the door 126 to the right side 158 of the door 126 such that the flexible chambers 300 and 302 are each generally coextensive with the door 126 along a direction perpendicular to the vertical direction V, e.g., the lateral direction L when the door 126 is in the closed position.

The first flexible chamber 300 and the second flexible chamber 302 may be vertically arranged within the outer casing 121, e.g., with the first flexible chamber 300 above the second flexible chamber 302. For example, the mullion 304 which at least partially defines the flexible chambers 300 and 302 may be horizontal, e.g., the mullion 304 may extend along a plane perpendicular to the vertical direction V, such as a plane defined by the lateral direction L and the transverse direction T, whereby the flexible chambers 300 and 302 defined on opposite sides of the horizontal mullion 304 are vertically arranged. As mentioned above, the flexible chambers 300 and 302 may be generally coextensive along the vertical direction V with the door 126. For example, the flexible chambers 300 and 302 may collectively extend along the vertical direction V from a bottom 152 of the door 126 to a top 154 of the door 126. As illustrated, e.g., in FIGS. 1 and 3, the second flexible chamber 302 may extend along the vertical direction V from the bottom 152 of the door 126 to the mullion 304 and the first flexible chamber 300 may extend along the vertical direction V from the mullion 304 to the top 154 of the door 126.

As mentioned above, the front panel 127 may selectively sealingly enclose the first and second flexible chambers 300 and 302. For example, the front panel 127 may be rotatable between an open position (e.g., FIG. 1) to provide access to the first and second flexible chambers 300 and 302 and a closed position, as shown, e.g., in FIG. 3. The sealing enclosure of the flexible chambers 300 and 302 by the front panel 127 may include sealing engagement between the mullion 304 and the front panel 127 when the front panel 127 is in the closed position. For example, the front panel 127 may include a resilient inner surface which abuts a front edge of the mullion 304 when the front panel 127 is in the closed position. As another example, a gasket or other sealing member as is generally understood in the art may also or instead be provided on one of the front panel 127 and the mullion 304.

Providing access to the flexible chambers 300 and 302 via the front panel 127 of the door 126 may advantageously increase accessibility of food items stored in the flexible chambers 300 and 302. For example, smaller food items such as a bag of frozen vegetables or a single-serving beverage container may be stored in the flexible chambers 300 and 302 to prevent or reduce such items from being obscured under or behind larger items such as a frozen turkey, frozen pizza, gallon of milk, etc., as compared to when only a single chamber of the refrigerator appliance 100 is provided for storing fresh food or frozen items.

Figure 4:
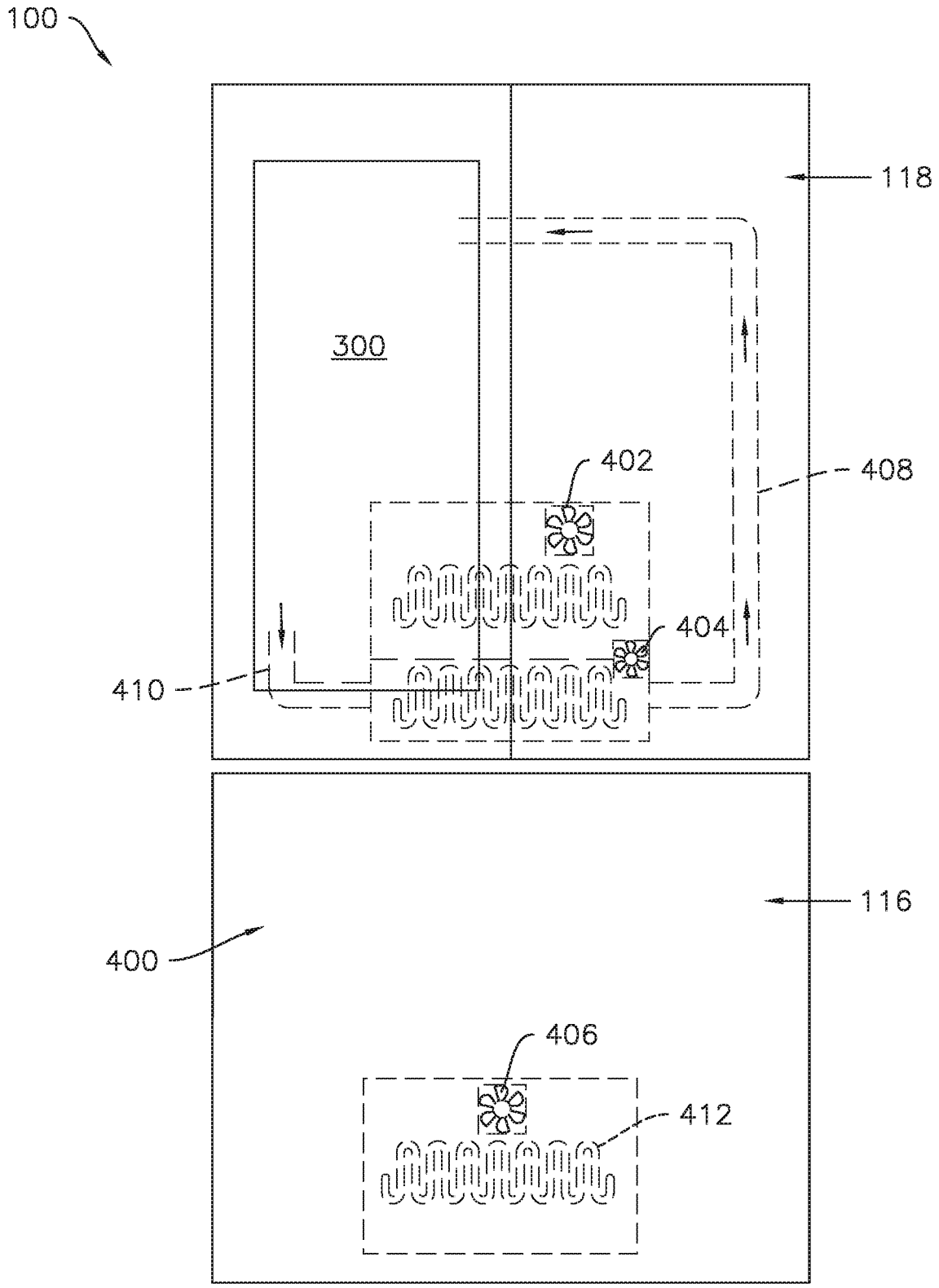
FIG. 4 provides a front schematic view of an exemplary refrigerator appliance including an exemplary cooling system thereof according to one or more additional embodiments of the present subject matter.

Turning now to FIG. 4, a sealed cooling system 400 according to one or more embodiments of the present subject matter is illustrated. In the example embodiment illustrated in FIG. 4, the refrigerator appliance 100 includes a fresh food chamber 118, a freezer chamber 116, and a single flexible chamber 300 defined in the left door of the fresh food chamber 118. As will be described in more detail below, the sealed cooling system 400 generally includes two or more expansion devices with one of the expansion devices dedicated to the flexible chamber 300 and a plurality of evaporators with a dedicated evaporator or portion of an evaporator for each of the fresh food chamber 118, the freezer chamber 116, and the flexible chamber 300.

FIG. 4 schematically illustrates air flow from the cooling system 400 to the flexible chamber 300 and from the flexible chamber 300 back to the cooling system 400. In particular, the cooling system 400 as illustrated in FIG. 4 includes a fresh food fan 402 configured to urge air from a first part of the cooling system 400 to the fresh food chamber 118, a door-in-door fan 404 configured to urge air from the first part of the cooling system 400 and/or from a second part of the cooling system 400 to the flexible chamber 300, and a freezer fan 406 configured to urge air from a third part of the cooling system 400 to the freezer chamber 116.

As mentioned, the cooling system 400 may include a dedicated evaporator or portion of an evaporator for each chamber, such that the first part, second part, and third part of the cooling system 400 includes at least two evaporators, where the third part of the cooling system 400 is a freezer evaporator, which in some embodiments may be referred to a first evaporator, and the first and second parts may be two separate additional evaporators or may be a first portion and a second portion of a second evaporator in other embodiments.

Returning specifically to FIG. 4, the cooling system 400 may include a plurality of ducts to route air between the cooling system 400 and the chambers 118, 116, and 300. For example, the cooling system 400 may include a door-in-door supply duct 408 extending from either the first part or the second part of the cooling system 400 (in various embodiments, the second part of the cooling system 400 may be either a door-in-door evaporator or a second portion of a second evaporator, which will be described in more detail below) to the flexible chamber 300 and a door-in-door return duct 410 extending from the flexible chamber 300 to the second part of the cooling system 400. The door-in-door fan 404 may be positioned and configured to urge air through the door-in-door supply duct 408 and the door-in-door return duct 410 to draw relatively warm air from the flexible chamber 300 through the door-in-door return duct 410 and to supply relatively cool air to the flexible chamber 300 through the door-in-door supply duct 408. The ducts 408 and 410 are generally separate from ducts supplying air to the fresh food chamber 118.

FIGS. 5 through 10 provide diagrams of exemplary embodiments of sealed cooling system 400. The sealed cooling system 400 generally comprises a single loop with a working fluid (e.g., refrigerant, which is not specifically illustrated) sealed within the single loop. For example, each of the evaporators or portions of an evaporator are all included in a single closed loop of piping and have a shared supply of working fluid amongst them. Thus, the evaporators generally operate sequentially, e.g., in at least some embodiments, cooled air is supplied to each chamber in order one at a time, or at most two at a time.

The sealed cooling system 400 includes a compressor 414 and a condenser 416 downstream of the compressor 414 with respect to the flow direction of the working fluid. That is, when the compressor 414 is activated, the compressor 414 pressurizes the working fluid (which is typically in a vapor phase at this point in the operation) within the single loop and the working fluid travels through the cooling system 400 to the condenser 416, where the working fluid releases heat or thermal energy and changes to a liquid phase. The liquid-phase working fluid then is selectively directed to one of a plurality of expansion devices, e.g., capillary tubes in the illustrated example embodiments, by a multi-way valve 418. The sealed cooling system 400 also includes a plurality of evaporators downstream of the condenser 416 with respect to the flow direction of the working fluid, e.g., the working fluid flows from the condenser 416 to one or more evaporators of the plurality of evaporators via the selected expansion device based on the position of the multi-way valve 418.

Figure 5:
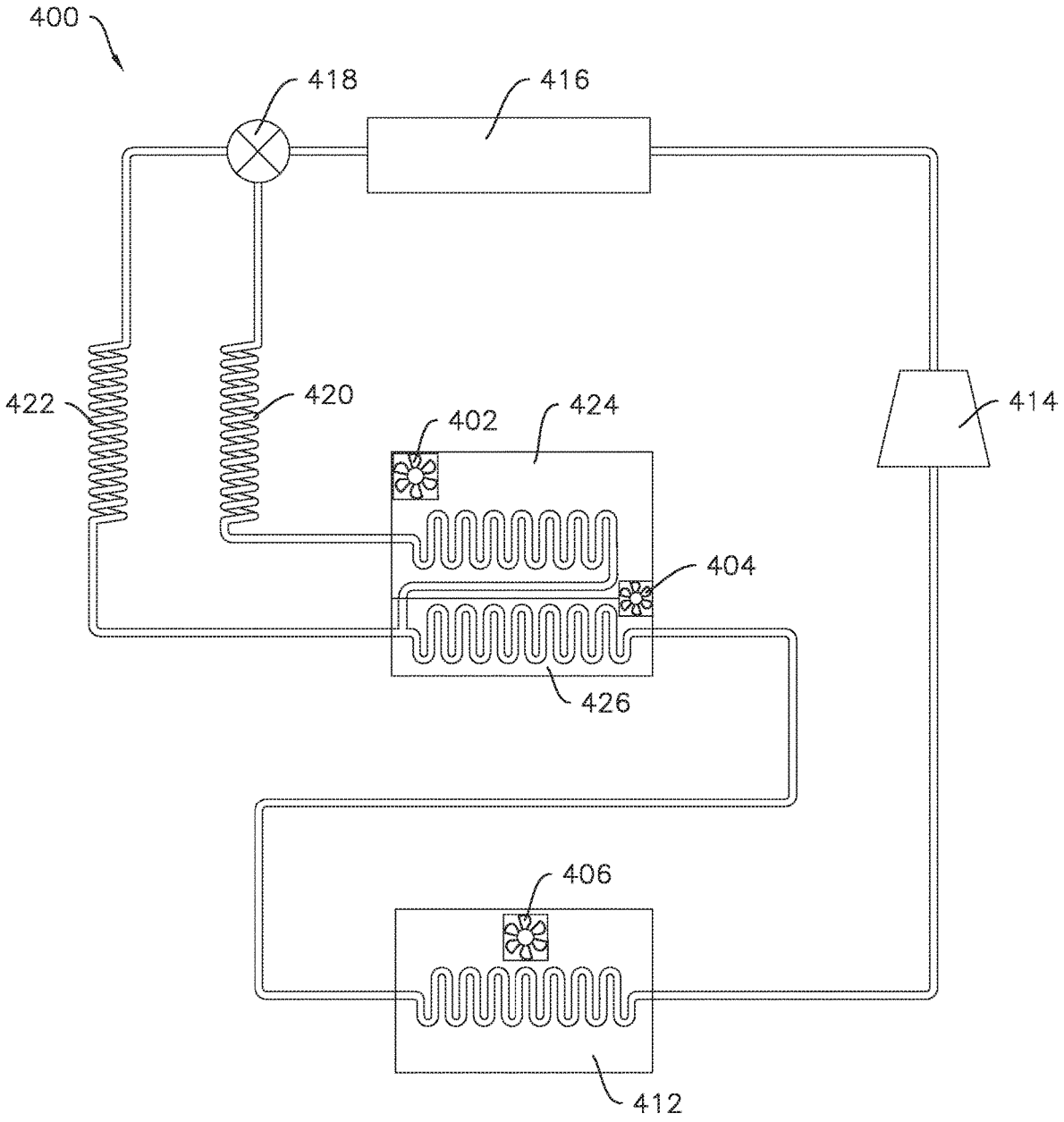
FIG. 5 provides a schematic view of an exemplary cooling system for a refrigerator appliance according to one or more embodiments of the present subject matter.

For example, as illustrated in FIG. 5, in some embodiments, the plurality of evaporators may include a freezer evaporator 412, a fresh food evaporator 424, and a door-in-door evaporator 426. In some embodiments, e.g., as illustrated in FIG. 5, the door-in-door evaporator 426 may be a downstream portion of the fresh food evaporator 424, e.g., the fresh food evaporator 424 and the door-in-door evaporator 426 may be directly connected with the door-in-door evaporator 426 immediately downstream of the fresh food evaporator 424, where the door-in-door evaporator 426 is defined by an inlet from a corresponding expansion device, e.g., capillary tube 422. The freezer evaporator 412 may be in fluid communication with the freezer fan 406, e.g., fluid communication with respect to air, such that the freezer fan 406 urges air from, e.g., directly from, the freezer evaporator 412 to the freezer chamber 116. The fresh food evaporator 424 may similarly be in fluid communication with the fresh food fan 402 such that the fresh food fan 402 urges air from the fresh food evaporator 424 to the fresh food chamber 116. The door-in-door evaporator 426 may be in fluid communication with the door-in-door fan 404 such that the door-in-door fan 404 urges air from the door-in-door evaporator 418 to the flexible chamber 300. In such embodiments, the multi-way valve 418 may be a three-way valve and the plurality of capillary tubes may include a first capillary tube 420 directly upstream of the fresh food evaporator 424 and a second capillary tube 422 directly upstream of the door-in-door evaporator 426. Each of the evaporators 424, 426, and 412 are connected in serial flow order to complete the singe loop, however, although the working fluid may travel through more than one evaporator or all of the evaporators, which evaporator(s) is or are actually active depends not only on the position of the multi-way valve 418 but also on which fan(s) are activated. In particular with respect to FIG. 5, the first capillary tube 420 may be a fresh food capillary tube which supplies working fluid to the fresh food evaporator 424 for operation of the fresh food evaporator 424 when the fresh food fan 402 is activated. The second capillary tube 422 may be a door-in-door/freezer capillary tube which supplies working fluid directly to the door-in-door evaporator 426 and which supplies working fluid to the freezer evaporator 412 via the door-in-door evaporator 426, where the door-in-door evaporator 426 and/or the freezer evaporator 412 may be activated when the multi-way valve 418 is positioned to direct the flow of working fluid to the second capillary tube 422, depending on which of the door-in-door fan 404 or the freezer fan 406 (or both) is or are activated. The second capillary tube 422 may be configured, e.g., sized, to provide a larger pressure drop than the first capillary tube 420, thereby allowing the cooling system 400 to provide colder air to the flexible chamber 300 and/or freezer chamber 116 than to the fresh food chamber 118. Thus, in this embodiment, where the door-in-door evaporator 426 is immediately downstream of the fresh food evaporator 424 with respect to a flow of working fluid from the first capillary tube 420 and is directly downstream of the second capillary tube 422, the flexible chamber 300 may be cooled to fresh food temperatures by positioning the three-way valve 418 to supply working fluid to the door-in-door evaporator 426 via the first capillary tube 420 and the fresh food evaporator 424, while the flexible chamber 300 may be cooled to freezer temperatures by positioning the three-way valve 418 to supply working fluid to the door-in-door evaporator 426 directly from the second capillary tube 422.

Figure 6:
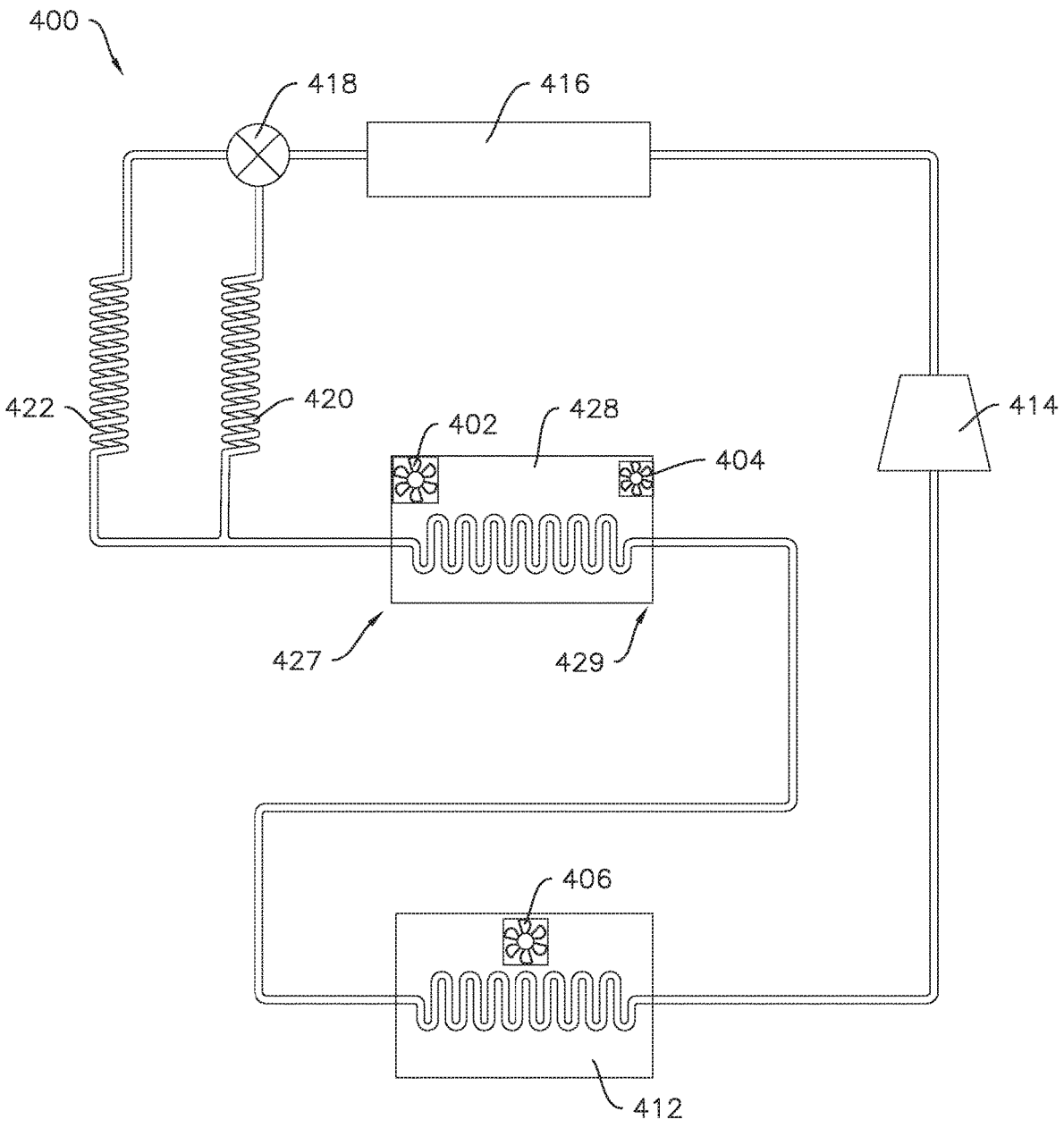
FIG. 6 provides a schematic view of an exemplary cooling system for a refrigerator appliance according to one or more additional embodiments of the present subject matter.

Turning now to FIG. 6, in some embodiments the plurality of evaporators may include, and may consist of, a first evaporator (freezer evaporator) 412 and a second evaporator 428. In such embodiments, the fresh food fan 402 may be in fluid communication, e.g., direct fluid communication, with either a first portion 427 of the second evaporator 428 or all of the second evaporator 428 and the door-in-door fan 404 may be in fluid communication, e.g., direct fluid communication, with either a second portion 429 of the second evaporator 428 or all of the second evaporator 428. For example, in some embodiments, the fresh food fan 402 may be in direct fluid communication with the first portion 427 of the second evaporator 428 such that the fresh food fan 402 urges air directly from the first portion 427 of the second evaporator 428 to the fresh food chamber 118, and the door-in-door fan 404 may be in direct fluid communication with the second portion 429 of the second evaporator 428 such that the door-in-door fan 404 urges air directly from the second portion 429 of the second evaporator 428 to the flexible chamber 300. In such embodiments, the door-in-door capillary tube, e.g., second capillary tube 422, may be directly upstream of an inlet of the fresh food evaporator 424, such that the second evaporator 428 is both the fresh food evaporator (when the working fluid is supplied from the first capillary tube 420) and the door-in-door evaporator (when the working fluid is supplied from the second capillary tube 422). In contrast to the example embodiment illustrated in FIG. 5, where the fresh food evaporator 424 and the door-in-door evaporator 426 are distinguished at least in part by separate inlets from the first and second capillary tubes 420 and 422, in the example embodiment illustrated by FIG. 6, the first and second capillary tubes 420 and 422 may both be connected to the second evaporator 428 at the same point, e.g., via a single inlet of the second evaporator 428. As in the embodiment illustrated in FIG. 5, the second capillary tube 422 in the example embodiment illustrated in FIG. 6 is also the freezer capillary tube. Additionally, the flexible chamber 300 may be cooled using the first capillary tube 420 in the embodiment illustrated in FIG. 6 when the flexible chamber 300 is set to warmer temperatures, e.g., fresh food temperatures, in a similar manner as described above, e.g., by positioning the multi-way valve 418 to direct the working fluid from the condenser 416 to the first capillary tube 420 and activating the door-in-door fan 404.

Figure 7:
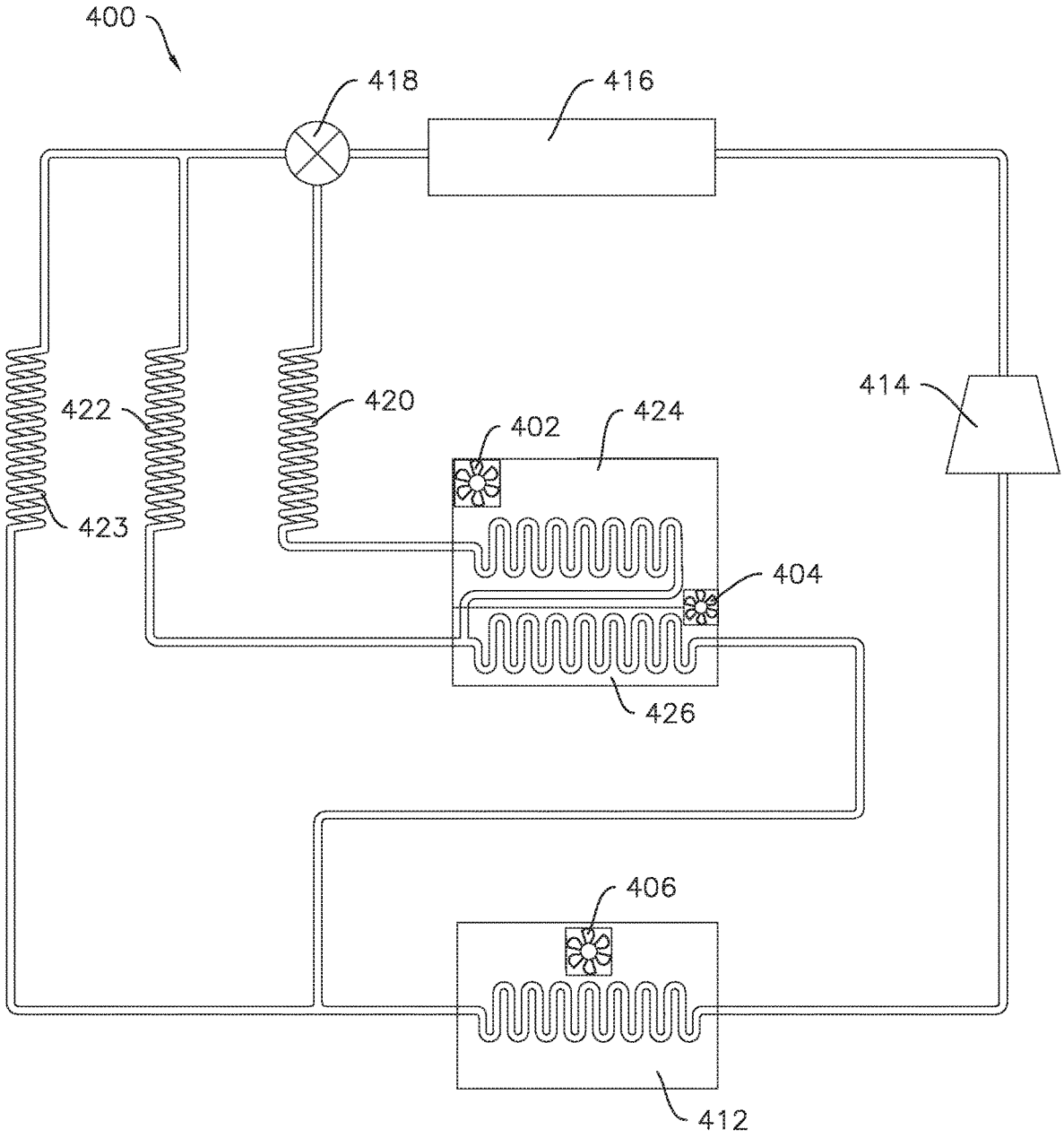
FIG. 7 provides a schematic view of an exemplary cooling system for a refrigerator appliance according to one or more further embodiments of the present subject matter.

Turning now to FIG. 7, in some embodiments the plurality of expansion devices may include the first capillary tube 420, the second capillary tube 422, and a third capillary tube 423. The third capillary tube 423 may be directly connected to the freezer evaporator 412. Thus, in this embodiment, the multi-way valve 418 is a four-way valve, the first capillary tube is fresh food capillary tube used for cooling the fresh food chamber 118 and/or for cooling the flexible chamber 300 when the flexible chamber 300 is set to fresh food temperatures, the second capillary tube 422 is a dedicated door-in-door capillary tube for cooling the flexible chamber 300 to freezer temperatures, and the third capillary tube 423 is a dedicated freezer capillary tube for cooling the freezer compartment 116.

Figure 8:
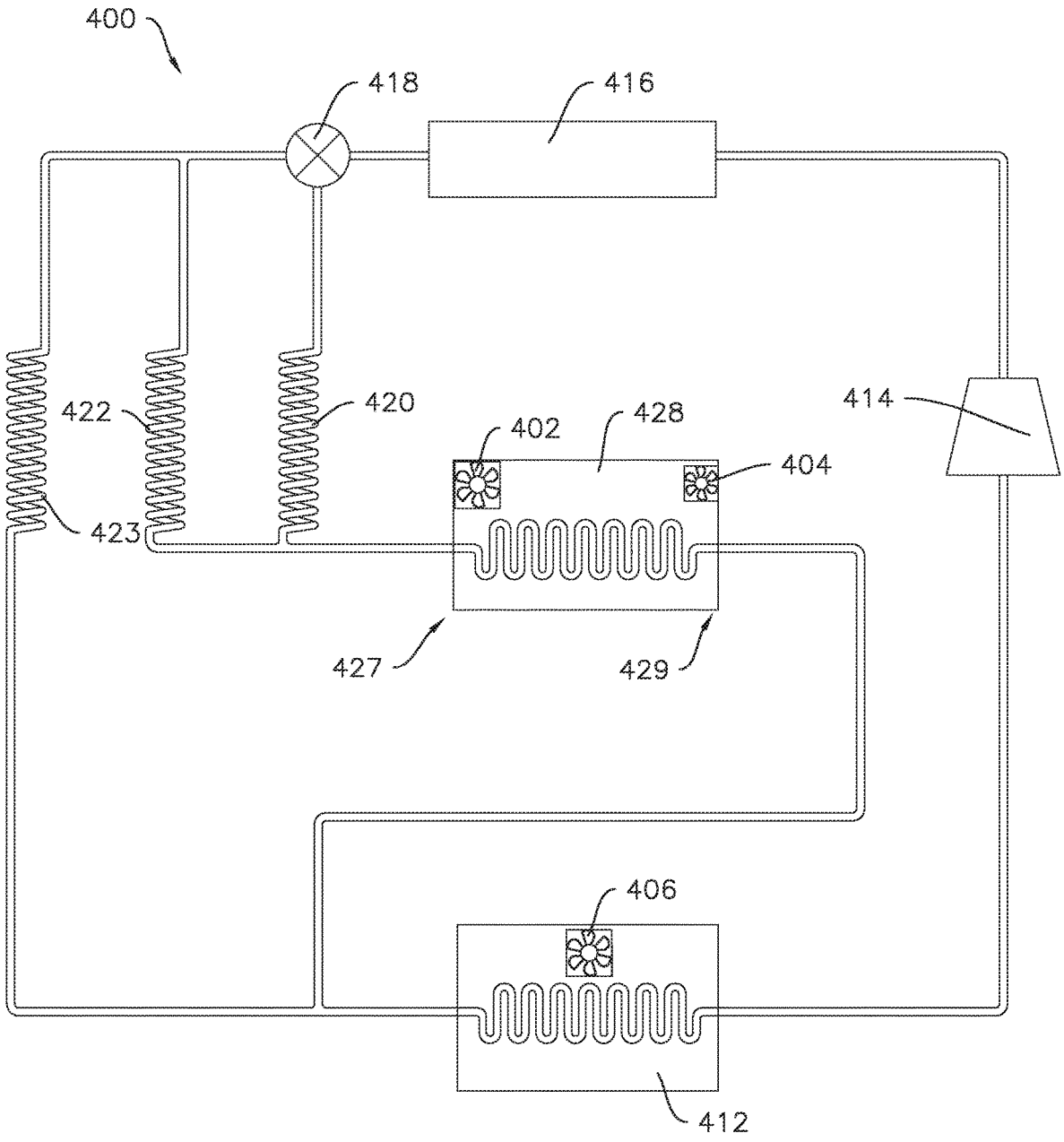
FIG. 8 provides a schematic view of an exemplary cooling system for a refrigerator appliance according to one or more further embodiments of the present subject matter.

Turning now to FIG. 8, a further embodiment of the sealed cooling system 400 is illustrated, where a single evaporator 428 is provided for both the fresh food chamber 118 and the flexible chamber 300, e.g., as described above with respect to FIG. 6, and where a third capillary tube 423 is provided, as a dedicated freezer capillary tube, e.g., as described above with respect to FIG. 7.

Figure 9:
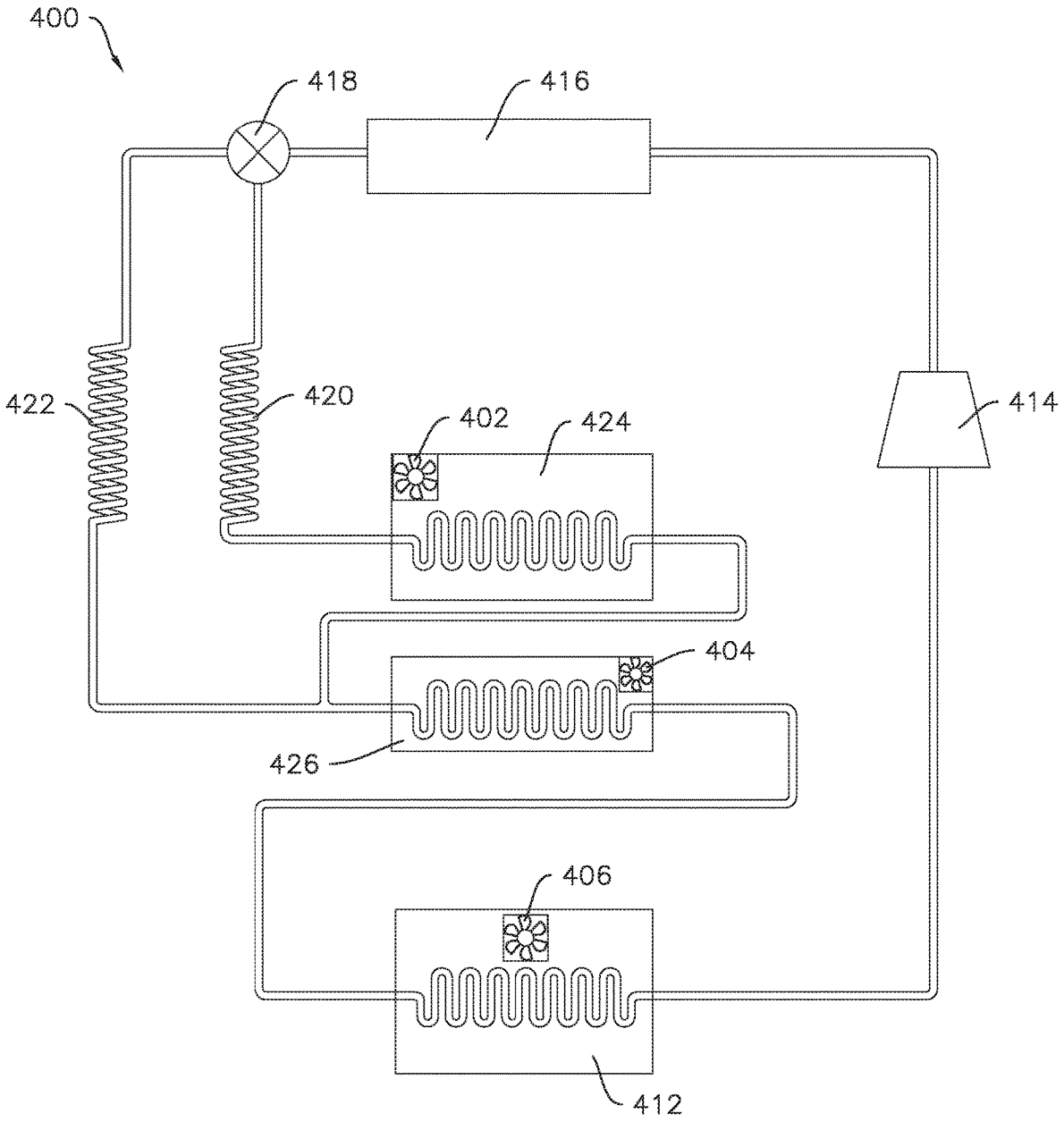
FIG. 9 provides a schematic view of an exemplary cooling system for a refrigerator appliance according to one or more further embodiments of the present subject matter.
Figure 10:
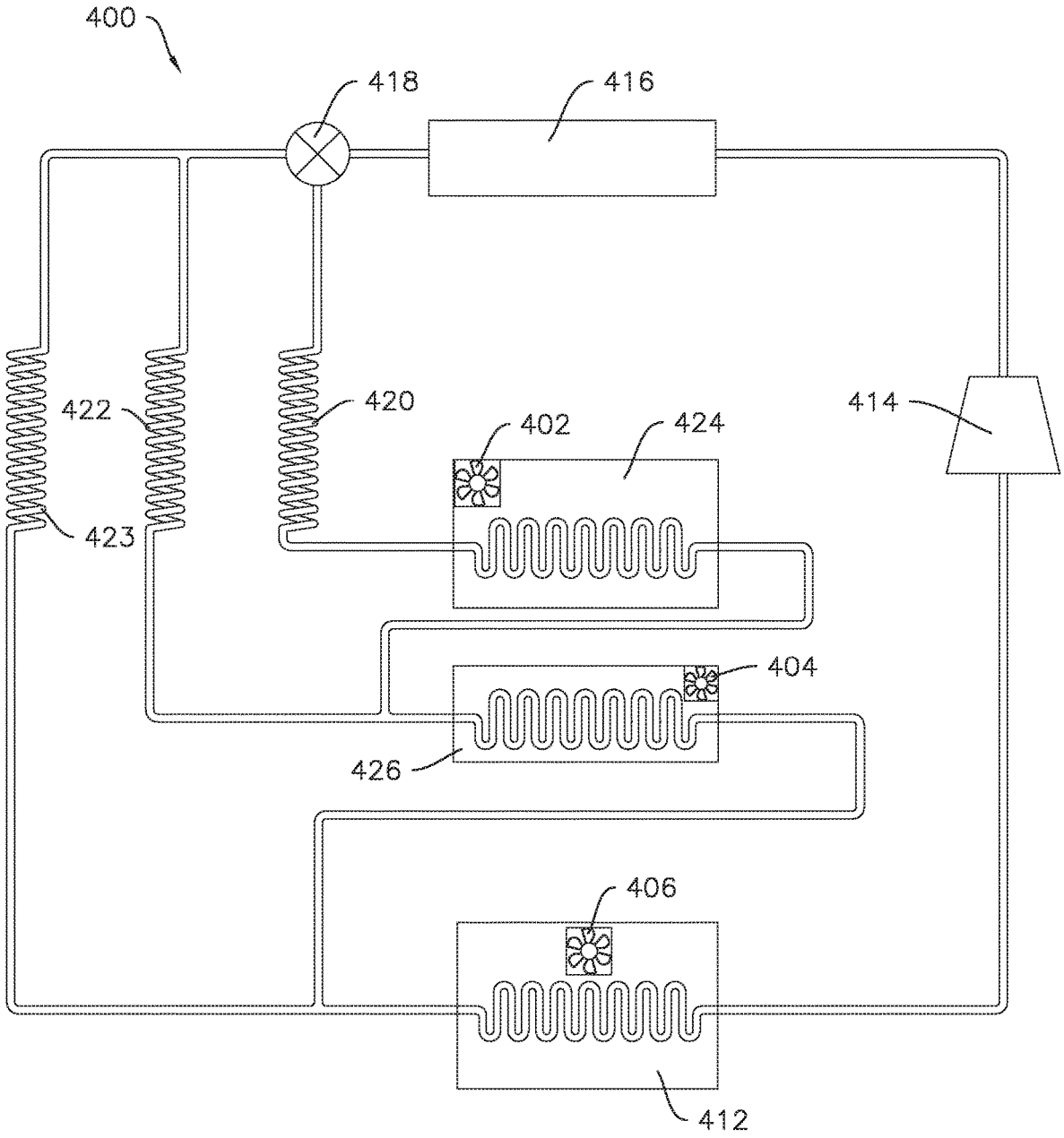
FIG. 10 provides a schematic view of an exemplary cooling system for a refrigerator appliance according to one or more further embodiments of the present subject matter.

In still further embodiments, e.g., as illustrated in FIGS. 9 and 10, the door-in-door evaporator 426 may be a separate assembly from the fresh food evaporator 424. In such embodiments, the door-in-door evaporator 426 may or may not participate during cooling of the fresh food chamber 118, e.g., the air from the fresh food chamber 118 may not contact the door-in-door evaporator 426. In FIG. 9, only a first capillary tube 420 and a second capillary tube 422 are provided, e.g., as described above with respect to FIG. 5. In FIG. 10, the first tube 420 is a fresh food capillary tube 420, the second capillary tube 422 is a door-in-door capillary tube 422, and the third tube 423 is a dedicated freezer capillary tube 423, e.g., as described above with respect to FIG. 7.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction and a transverse direction, the vertical, lateral and transverse directions being mutually perpendicular, the refrigerator appliance comprising:

a cabinet extending from a top to a bottom along the vertical direction, the cabinet also extending from a left side to a right side along the lateral direction, the cabinet defining a fresh food chamber and a freezer chamber, the fresh food chamber extending along the vertical direction between the top and the bottom of the cabinet, along the lateral direction between the left and right sides of the cabinet, and along the transverse direction between a front portion and a back portion, the front portion of the fresh food chamber defining an opening for receipt of food items;

a door rotatably mounted to the cabinet at the front portion of the fresh food chamber such that the door rotates between a closed position where the door sealingly encloses at least a portion of the fresh food chamber and an open position to permit access to the fresh food chamber, the door comprising an outer casing comprising a thermally insulated wall, a flexible chamber defined within the door by the outer casing, and a front panel rotatably mounted to the outer casing of the door such that the front panel of the door permits access to the flexible chamber; and a sealed cooling system configured to provide cooled air to the fresh food chamber, the freezer chamber, and the flexible chamber, the sealed cooling system comprising:

a single loop with a working fluid sealed within the single loop;

a compressor;

a condenser downstream of the compressor with respect to the flow direction of the working fluid;

a plurality of evaporators downstream of the condenser with respect to the flow direction of the working fluid;

a fresh food fan configured to urge air from a first part of the cooling system to the fresh food chamber;

a door-in-door fan configured to urge air from at least one of the first part of the cooling system or a second part of the cooling system to the flexible chamber;

a freezer fan configured to urge air from a third part of the cooling system to the freezer chamber; and a multi-way valve downstream of the condenser and upstream of a plurality of capillary tubes, each capillary tube of the plurality of capillary tubes directly upstream of at least one evaporator of the plurality of evaporators, the plurality of capillary tubes comprising a first capillary tube connected to a first outlet of the multi-way valve and a second capillary tube connected to a second outlet of the multi-way valve;

wherein the plurality of evaporators comprises a freezer evaporator in fluid communication with the freezer fan whereby the freezer fan urges air from the freezer evaporator to the freezer chamber and a second evaporator, the fresh food fan in fluid communication with at least a first portion of the second evaporator whereby the fresh food fan urges air from the second evaporator to the fresh food chamber, and the door-in-door fan in fluid communication with at least a second portion of the second evaporator whereby the door-in-door fan urges air from the second evaporator to the flexible chamber, wherein the first capillary tube is directly upstream of the first portion of the second evaporator and the second capillary tube is directly upstream of the first portion of the second evaporator.

2. The refrigerator appliance of claim 1, wherein the multi-way valve is a three-way valve and the freezer evaporator is downstream of the second evaporator.

3. The refrigerator appliance of claim 1, wherein the multi-way valve is a four-way valve, further comprising a third capillary tube downstream of the four-way valve and directly upstream of the freezer evaporator.

4. A sealed cooling system for a refrigerator appliance, the refrigerator appliance comprising a freezer chamber, a fresh food chamber, and a flexible chamber defined in a door of the refrigerator appliance, the sealed cooling system comprising:

a single loop with a working fluid sealed within the single loop;

a compressor;

a condenser downstream of the compressor with respect to the flow direction of the working fluid;

a plurality of evaporators downstream of the condenser with respect to the flow direction of the working fluid;

a fresh food fan configured to urge air from a first part of the cooling system to the fresh food chamber;

a door-in-door fan configured to urge air from at least one of the first part of the cooling system or a second part of the cooling system to the flexible chamber;

a freezer fan configured to urge air from a third part of the cooling system to the freezer chamber; and a multi-way valve downstream of the condenser and upstream of a plurality of capillary tubes, the plurality of capillary tubes comprising a first capillary tube connected to a first outlet of the multi-way valve and a second capillary tube connected to a second outlet of the multi-way valve, wherein each capillary tube of the plurality of capillary tubes is directly upstream of at least one evaporator of the plurality of evaporators;

wherein the plurality of evaporators comprises a freezer evaporator in fluid communication with the freezer fan whereby the freezer fan urges air from the freezer evaporator to the freezer chamber and a second evaporator, the fresh food fan in fluid communication with at least a first portion of the second evaporator whereby the fresh food fan urges air from the second evaporator to the fresh food chamber, and the door-in-door fan in fluid communication with at least a second portion of the second evaporator whereby the door-in-door fan urges air from the second evaporator to the flexible chamber, wherein the first capillary tube is directly upstream of the first portion of the second evaporator and the second capillary tube is directly upstream of the second portion of the second evaporator.

5. The cooling system of claim 4, wherein the multi-way valve is a three-way valve and the freezer evaporator is downstream of the second evaporator.

6. The cooling system of claim 4, wherein the multi-way valve is a four-way valve, further comprising a third capillary tube downstream of the four-way valve and directly upstream of the freezer evaporator.

* * * * *